US005472531A

United States Patent [19]

Turci et al.

[11] Patent Number: 5,472,531

[45] Date of Patent: Dec. 5, 1995

[54] INSENSITIVE EXPLOSIVE COMPOSITION

[75] Inventors: Joseph Turci, Long Valley, N.J.; Mark Mezger, Mt. Bethel, Pa.; Bernard Strauss, Rockaway; Thelma Manning, Montville, both of N.J.

[73] Assignee: The United States of America as represented by the Secretary of the Army, Washington, D.C.

[21] Appl. No.: 385,843

[22] Filed: Feb. 1, 1995

Related U.S. Application Data

[63] Continuation of Ser. No. 983,954, Dec. 1, 1992, abandoned.

[51] Int. Cl.[6] ..... C06B 25/34

[52] U.S. Cl. ..... 149/92; 149/88; 149/109.6

[58] Field of Search ..... 149/92, 88, 109.6

[56] References Cited

U.S. PATENT DOCUMENTS 4,775,432 10/1988 Kolonko et al. ..... 149/19.4
4,842,659 6/1989 Mezger et al. ..... 149/19.2
4,853,051 8/1989 Bennett et al. ..... 149/19.4
5,240,523 8/1993 Willer ..... 149/19.4

*Primary Examiner*—Donald P. Walsh
*Assistant Examiner*—Anthony R. Chi
*Attorney, Agent, or Firm*—Anthony T. Lane; Edward Goldberg; John E. Callaghan

[57] ABSTRACT

The explosive blasting composition in this invention contains 1 to 40 percent Aluminum powder, 40 to 80 percent Cyclotetramethylene Tetranitramine, 4 to 15 percent Cellulose Acetate Butyrate, 5 to 20 percent of 1:1 mixture of bis 2,2-dinitropropyl acetate and bis 2,2-dinitropropyl formal, and, and 0.25 to 0.75 percent Tri (dioctyl Phosphato) Titanate.

The method of making the above composition consists of combining Cyclotetramethylene Tetranitramine, Cellulose Acetate Buterate, 1:1 bis 2,2-dinitropropyl acetate and bis 2,2-dinitropropropyl formal, and tri (dioctyl phosphato) titanate, mixed at an elevated temperature for a period of time. Prior to blowdown, the Aluminum powder is added. to the mix. Mixing continues and blowdown is initiated to remove excess solvents for the purpose of extrusion.

5 Claims, No Drawings

INSENSITIVE EXPLOSIVE COMPOSITION

GOVERNMENTAL INTEREST

The invention described herein may be manufactured used and licensed by or for the Government for Governmental purposes. This application is a continuation of application Ser. No. 07/983,954, filed Dec. 1, 1992 now abandoned.

FIELD OF USE

This invention relates to an Insensitive Aluminized Blasting Composition and a method of making the same.

BACKGROUND

The conventional Blasting composition used by the military was a German based explosive composition called HALWC. This was used worldwide until it was found that it lacked the basis for safety. In otherwords, it was found the composition of the art was potentially sensitive to bullet impact, fragment impact and sympathetic detonation. Therefore it was never allowed to be shipped by the military on any Navy vessel. This hampered the Armed forces and greatly limited it's use in the United States.

It was found to require extensive research and development to modify the composition so that it may be transported, or qualified in many, many ways, according to U.S. criteria. Safety is the uppermost in the minds of the military when fielding such compositions.

We have found that our composition is the only composition at present, that can meet safety requirements. Various tests have shown that our composition performs as well or even better than any experimental blasting composition known to date. In fact our tests have shown that it performs ten percent better than the compositions of the art.

SUMMARY OF INVENTION

This invention is directed to an insensitive aluminized blasting explosive composition. The composition of this invention is as follows:

1 to 40 percent Aluminum Powder (atomized)
40 to 90 percent Cyclotetramethylene Tetranitramine
4 to 15 percent Cellulose Acetate Butyrate
5 to 20 percent of a 1:1 mixture of bis 2,2-dinitropropyl acetate and bis 2,2-dinitropropyl formal.
0.25 to 0.75 percent Neo alkoxy, Tri (Dioctyl Phosphato) Titanate Note 1: HMX is Cyclotetramethylene Tetranitramine.

Note 2: CAB is Cellulose Acetate Butyrate.

Note 3: BDNPA/F is a 1:1 mixture of BIS 2,2-Dinitropropyl acetate and BIS 2,2-Dinitropropyl formal.

Note 4: LICA-12 is Neo alkoxy, Tri (Dioctyl Phosphato) Titanate.

METHOD OF MAKING PREFERRED EMBODIMENT OF THE INVENTION

The composition of this invention is manufactured by the standard propellent solvent process.

A. Mixing is performed in a horizontal sigma mixer.
B. Mix 4 parts Ethyl Acetate and one part Ethyl Alcohol. The total solvents used would be equal approximately 20 to 30 percent of the total mix weight.
C. Add to this mix the following ratio: 80 percent HMX, 8 percent CAB, 12 percent BDNPA/F.
D. Add to this mix 0.5 percent LICA-12.

E. Add to this mix 25 percent aluminum powder by weight prior to blowdown.
F. These ingredients are mixed for approximately 1 to 2 hours, at a temperature of 105 to 120 degrees Fahrenheit.
G. This is then extruded into strands and fed into a standard propellent cutter.
H. This material is then dried at ambient temperature.
I. It is then oven dried to remove any solvents.

In the composition of the present invention we should not go below 40 percent HMX because the energy will be too low. Nor should we go above 90 percent because it will become difficult to process. The limit of 4 percent CAB is adhered to because there is too little Cellulose colloidal agent and therefore it is difficult to process. Above 15 percent, the composition is inert. However, we have chosen 5 percent BDNPA/F in our composition because below this amount the composition becomes too ridged and sensitive. Above 20 percent BDNPA/F there is too little energy to be released. Optionally LICA-12 may be used but not below 0.25 percent because it does not have the structural integrity to be able to cut. However, again, above 0.75 percent the composition is too inert. In any case the contribution of this invention is the addition of aluminum and energetic binder. However, the aluminum should be held to at least 1 percent because below that figure not enough energy is contributed. And above 40 percent the HMX content is greatly reduced thus reducing energy for our various uses. The size of the aluminum particles can vary from 0.01 to 200 microns.

Procedure for Making (High Range of Aluminum)

The composition in this invention is manufactured by the standard propellent solvent process.

A. Mixing is performed in a horizontal sigma mixer.
B. Mix 4 parts Ethyl Acetate and one part Ethyl Alcohol. The total solvents used would equal approximately 20 to 30 percent of the total mix weight.
C. Add to this mix the following ratio: 50 percent HMX, 4 percent CAB, 5 percent BDNPA/F.
D. Add to this mix 0.25 percent LICA-12.
E. Add to this mix 40 percent aluminum powder prior to blowdown.
F. These ingredients are mixed for approximately 1 to 2 hours at a temperature of 105 to 120 degrees F.
G. This mix is then extruded into strands and fed into a standard propellent cutter.
H. This material is then dried at ambient temperature.
I. It is then oven dried to remove any solvents.

Procedure for Making (Low Range of Aluminum)

The composition in this invention is manufactured by the standard propellent solvent process.

A. Mixing is performed in a horizontal sigma mixer.
B. Mix 4 parts Ethyl acetate and 1 part ethyl alcohol. The total solvents used would equal approximately 20 to 30 percent of the total mix weight.
C. Add to this mix the following ratio: 89.5 percent HMX, 5 percent CAB, 5 percent BDNPA/F.
D. Add to this mix 0.5 percent LICA-12.
E. Add to this mix 1.0 percent aluminum powder by weight prior to blowdown.
F. These ingredients are mixed for approximately 1 to 2 hours, at a temperature of 105 to 120 degrees F.
G. This mix is then extruded into strands and fed into a standard propellent cutter.
H. This material is then dried at ambient temperature.
I. It is then oven dried to remove any solvents.

Preferred Composition 19.92 percent Aluminum Power (Atomized).
63.65 percent Cyclotetramethylene Tetranitramine.
6.37 percent Cellulose Acetate Butyrate.
9.56 percent of a 1:1 mixture of BIS 2,2-Dinitropropyl acetate and BIS 2,2-Dinitropropyl formal.
0.5% Neo alkoxy, Tri (dioctyl phosphato) titanate.

Note 1: Graphite may be added to reduce tackiness of material.

Note 2: These material can also be substituted for BDNPA/F: Methyl-2-nitrato ethyl nitramine or Ethyl-2-nitrato ethyl nitramine or Metriol trinitrate or Triethyleneglycol-dinitrate.

Note 3: These materials can be substituted for LICA-12: CAB-O-SIL or Epoxy Resin(Shell EPON-828). CAB-O-SIL is made by Cabot Corporation, Tuscola, Ill. The Epoxy Resin is made by Miller Stevenson Chemical Company, Danburry, Conn.

Note 4: Cyclotrimethylene Trinitramine (RDX) can be substituted for Cyclotetramethylene Tetranitramine (HMX).

Utility

This explosive is used in the Penetration Augmented Munition as well as having potential for use on the guns for the Bradley Fighting vehicle, in addition it has applications in the following programs which involve blasting munitions: Multi-purpose Individual Munition, Bunker defeat Munition, Explosive foxhole digger, Bridge Road Munition, and any mining or rock blasting application.

Our invention is a blasting explosive that can be used in rock blasting or any demolition device. There isn't any other composition having the insensitivity of our composition in use today.

Our composition has great potential for use in the area of metal accelerating explosives such as shaped charge, Explosively Formed Penetrators, and fragmenting warhead, this is because we have found that a small percentage of aluminum can enhance blast pressure and detonation velocity in various items in the munitions aresenal of the U.S. Army.

IMPACT SENSITIVITY

| MATERIAL | 50% Firing Height (cm) |
|---|---|
| Composition of this Invention | 79.7 |
| Comp A3 Type II | 43 |
| LX-14 | 26 |

SUBSCALE PERFORMANCE COMPARISON

| Explosive Type | % Load Hearing Reduction |
|---|---|
| Comp A3 Type II | 93.4% |
| Composition of this Invention | 95% |

Note 1: Load bearing reduction refers to the residual strength that remains in the concrete structure after the explosive is detonated. In otherwords, the greater the percentage of load bearing reduction, the more effective the explosive.

Note 2: Our composition is the only one that is not sensitive to impact sensitivity, or sympathetic detonation. Again it may be said there is no other Insensitive Blasting composition other than ours in the Art. There is no way of reducing the vulnerability of existing explosives without greatly reducing the performance characteristics. Of the other blasting compositions of the Art none have the same energy level and insensitive characteristics as our composition. It has been found that our explosive will give whatever munition it is put into, less vulnerability on the battlefield to impact sensitivity or sympathetic explosive. And it is safe to use in industrial applications such as rock blasting.

What is claimed is:

1. A compacted, insensitive explosive having improved blasting characteristics and prepared by the process of:

(a) forming a first mixture of (i) a volatile solvent, (ii) cyclotetramethylene tetranitramine (HMX), (iii) cellulose acetate butryate, and (iv) a member selected from methyl-2-nitrato,- ethyl nitramine, metriol trinitrate, triethylene glycol dinitrate, bis 2,2-dinitropropyl acetate and 2,2-dinitropropyl formal, (b) mixing until the blow down point is reached, (c) adding aluminum powder to the first mixture, the aluminum being in an amount of 1% to 40% by weight of the non-volatile ingredients of the first mixture, (d) continuing the mixing and conducting a blow down of solvent to form a second mixture, (e) extruding the second mixture into strands, (f) cutting the strands and drying the cuttings.

2. The composition of claim 1 wherein the HMX is present in an amount of 40 to 90 percent by weight of the first mixture.

3. The composition of claim 3 wherein the CAB is present in an amount of 4 to 15 percent by weight of the first mixture.

4. The composition of claim 3 wherein the aluminum is present in an amount in the range of 20 to 40 percent by weight of the ingredients of the first mixture.

5. The composition of claim 4 wherein there is by weight 19.92% aluminum powder, 63.65% HMX and 6.37% CAB.

* * * * *